United States Patent [19]

Domoto et al.

[11] Patent Number: 4,671,176

[45] Date of Patent: Jun. 9, 1987

[54] OPERATION LEVER CONTROLLER FOR TWO-COLOR PRINTING APPARATUS

[75] Inventors: Hideki Domoto; Takashi Kimura, both of Hiroshima, Japan

[73] Assignee: Ryobi Ltd., Hiroshima, Japan

[21] Appl. No.: 849,581

[22] Filed: Apr. 8, 1986

[30] Foreign Application Priority Data

Apr. 12, 1985 [JP] Japan ..... 60-55181[U]

[51] Int. Cl.[4] ..... B41F 7/02

[52] U.S. Cl. ..... 101/177; 101/183; 101/136; 101/142

[58] Field of Search ..... 101/136, 137, 138, 139, 101/140, 141, 142, 143, 144, 145, 177, 178, 179, 180, 181, 183, 184, 217, 218, 219, 221

[56] References Cited

U.S. PATENT DOCUMENTS

| | | | |
|---|---|---|---|
| 2,845,860 | 8/1958 | Mestre | 101/177 |
| 3,731,624 | 5/1973 | Kaneko et al. | 101/142 |
| 3,956,985 | 5/1976 | Ishii | 101/142 |
| 4,434,716 | 3/1984 | Ishii et al. | 101/142 |
| 4,475,456 | 10/1984 | Ishii et al. | 101/233 X |

FOREIGN PATENT DOCUMENTS 208055 12/1983 Japan .

*Primary Examiner*—Charles A. Pearson

*Attorney, Agent, or Firm*—Sughrue, Mion, Zinn, Macpeak and Seas

[57] ABSTRACT

An operation lever controller for a two-color printing apparatus having first and second units adapted to perform printing independently of each other and arranged such that all steps of respective printing operations are performed by rotating respective operation levers in multiple stages. The operation levers, ratchet wheels, set cams for changing and positioning the operation levers in respective multiple stages and arms provided with respective magnets are fixed on corresponding drive shafts of the first and second units. Pairs of feed pallets are respectively provided on unit frames so as to be linked with forward-drive solenoids, backward-drive solenoids, and pallet-drive shafts such that the respective pairs of feed pallets are disengaged and engaged with the ratchet wheels by operations of the solenoids to perform feeding operations using the pallet-drive shafts. Operation lever detecting switches are turned on by the magents at respective positions of the operation levers.

6 Claims, 11 Drawing Figures

| OPERATION OF EACH PART \ POSITION OF OPERATION LEVER | I | II | III | IV | V |
|---|---|---|---|---|---|
| TURNING ON/OFF OF MOISTURE SUPPLY PORTION | | | | | |
| TOUCH OF FORM ROLLERS WITH PLATE CYLINDERS | | | | | |
| FORCIBLE TOUCH OF PLATE CYLINDERS WITH BLANKET CYLINDERS | | | | | |

OPERATION LEVER CONTROLLER FOR TWO-COLOR PRINTING APPARATUS

BACKGROUND OF THE INVENTION

The present invention relates to an operation lever controller for a two-color printing apparatus having first and second units which are arranged so to be able to perform printing independently of each other.

Generally, as shown by way of example in FIG. 1, a two-color printing apparatus includes a first unit A provided with a first plate cylinder 1, a first blanket cylinder 2, and other devices necessary for printing; a conveyor cylinder 3; an impression cylinder 6; a paper supply device 7; a paper discharge device 8; a paper supply stand 9; a paper discharge stand 10; etc. In this apparatus, after a first printing has been made with a first color between the first blanket cylinder 2 and the impression cylinder 6 onto paper (not-shown) suppled to the first unit A, a second printing is made through the impression cylinder 6 with a second color between the second blanket cyliner 5 and the impression cylinder 6 in the second unit B. The first and second units A and B are operated by their respective operation levers provided thereon.

In such a two-color printing apparatus, however, there are commonly problems regarding image misalignment between the first and second colors, in the unavoidable complexity and difficulty in operations of mounting/dismounting the respective cylinders, supplying/dismounting plates, supplying moisture, inking, cleaning blankets, etc., and/or in changeover operations between the first and second units A and B.

SUMMARY OF THE INVENTION

As a result of studies concerning the abovementioned problems of the prior art printing apparatus, an object of the present invention is to provide a two-color printing apparatus in which image alignment between two colors is achieved and changeover between monochromatic printing and dichromatic printing can be performed easily. It is a further object to provide such a printing apparatus in which an operation lever system is arranged such that all printing processes can be easily controlled with a single operation lever (as proposed by the present Applicant in Japanese Unexamined Patent Publication No. 58-208055) and which is suitably applicable to a two-color printing apparatus, whereby both first and second units can be controlled by an operation lever of the first unit, and that in the case where a monochromatic printing mode is selected by a changeover switch, a printing operation by the selected one of the units can be controlled by the operation lever of the selected unit.

In order to solve the above-mentioned problems, according to the present invention, an operation lever controller for a two-color printing apparatus which is provided with first and second units A and B adapted to perform printing independently of each other and which is arranged such that all steps of the respective printing operations are performed by rotating respective operation levers in multiple stages, is featured in that operation levers, ratchet wheels, set cams for changing and positioning the operation levers in respective multiple stages, and arms provided with respective magnets are fixed on corresponding drive shafts of the first and second units; pairs of feed pallets are respectively provided on unit frames so as to be linked with forward-drive solenoids, backward-drive solenoids, and pallet-drive shafts such that the respective pairs of feed pallets are disengaged and engaged with the ratchet wheels by means of the forward-drive solenoids and backward-drive solenoids, respectively, to be able to perform feeding operations by means of the pallet-drive shafts; and respective sets of operation lever position detection switches arranged to be turned on by the magnets at respective positions of the operation levers and changeover switches for changing over the first and second units between use and disuse are provided on the respective unit frames. With this arrangement, it is possible to control the first and second units by the respective operation levers independently of each other, and further it is possible to control both the first and second units by the operation lever of the first unit.

DESCRIPTION OF THE PREFERRED EMBODIMENTS

Figure 1:
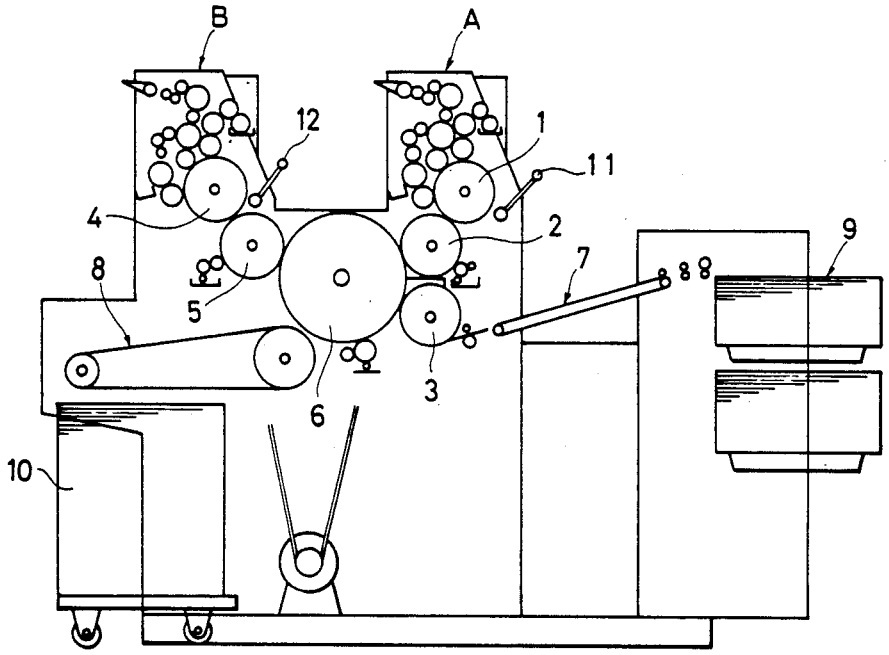
FIG. 1 PRIOR ART
FIG. 1 is a schematic side view showing a two-color printer in which the apparatus of the present invention can be employed to advantage.
Figure 2:
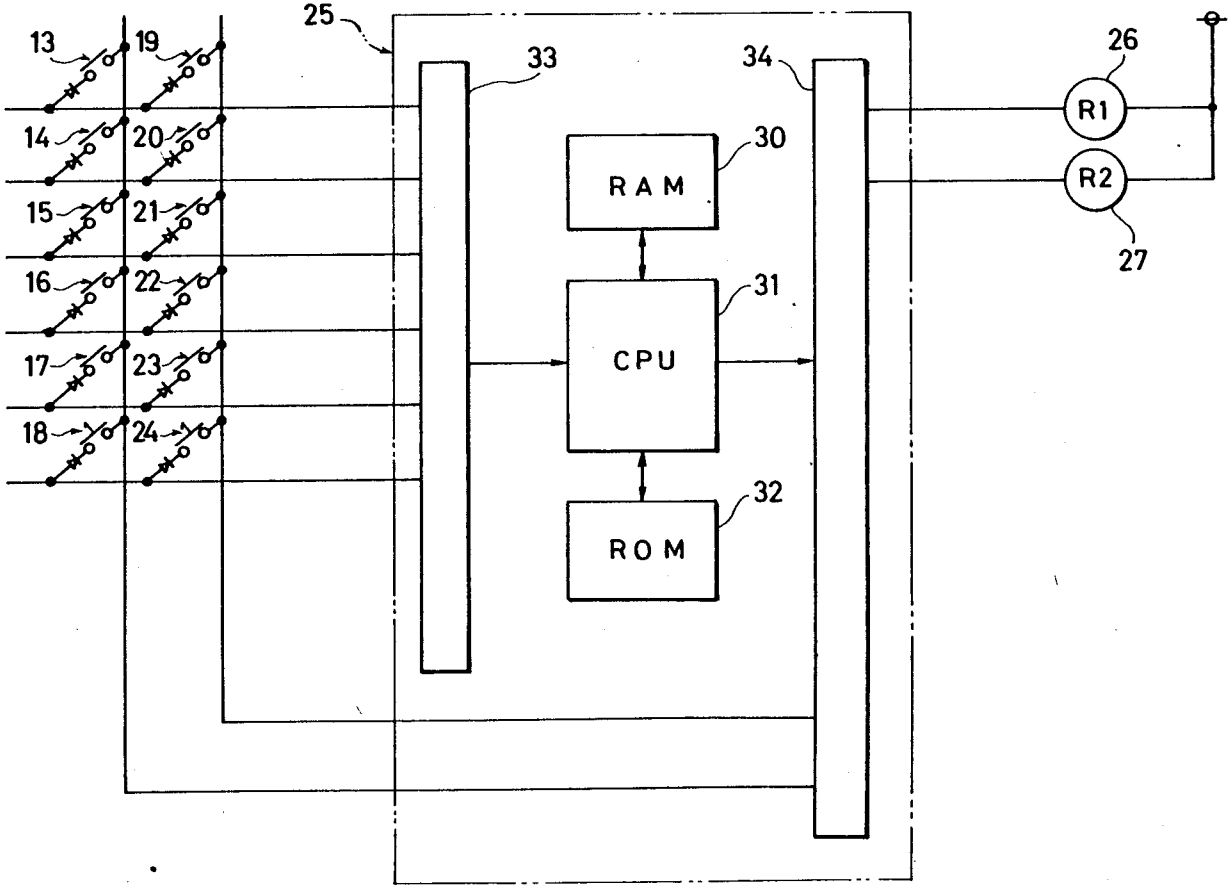
FIGS. 2 and 3 are diagrams of a control circuit for a preferred embodiment of an operation lever controller for a two-color printing apparatus of an operation lever controller for a two-color printing apparatus according to the present invention.
Figures 3, 4:
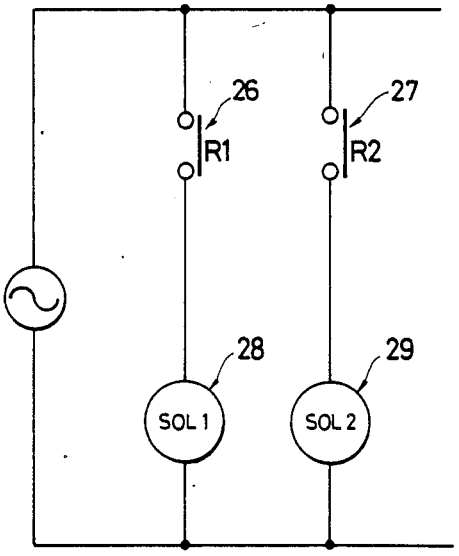
FIG. 4 is a diagram depicting a mechanical operation controlled by the operation lever in the above embodiment.

Referring to the drawings, a preferred embodiment of the present invention will be described in detail hereunder. FIGS. 2 and 3 are diagrams showing a control circuit, and FIG. 4 is a view showing mechanical operations controlled by respective operation levers 11 and 12 of first and second units A and B.

Figure 7:
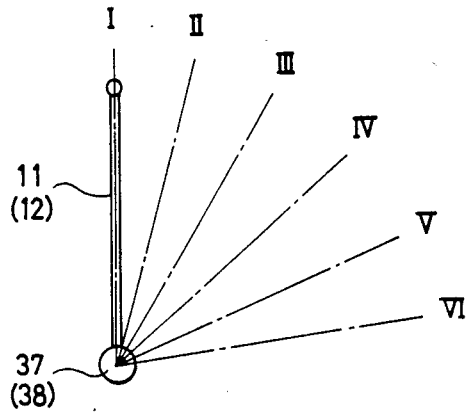
FIG. 7 is a diagram for explaining the changed-over positions of the operation lever in the above embodiment.

In FIG. 2, reference numerals 13 through 17 designate switches for detecting respective positions of the operation lever 11 in the first unit A. The switches 13, 14, 15, 16 and 17 are turned on at respective positions I, II, III, IV and V of the operation lever 11, as shown in FIG. 7.

Reference numeral 18 designates a switch for setting the operation mode of the first unit A to either the in-use or out-of-use mode. An alternating type pushbutton switch or the like may be used as the switch 18.

Reference numerals 19 through 23 designate switches for detecting respective positions of the operation lever 12 in the second unit B. The switches 19, 20, 21, 22 and 23 are turned on at respective positions I, II, III, IV and V of the operation lever 12, similarly to the case of the operation lever 11 of the first unit A.

Reference numeral 24 designates a switch for selectively setting the operation mode of the second unit B to either the in-use or out-of-use mode. An alternating type pushbutton switch or the like may be used as the switch 24.

Reference numeral 25 designates a microcomputer. In FIGS. 2 and 3, reference numeral 26 designates a relay for controlling a backward-drive solenoid 28 for moving backwardly the operation lever 12 in the second unit B, 30 designates a RAM, 31 a CPU, 32 a ROM, 33 an input interface, and 34 an output interface.

Figure 5:
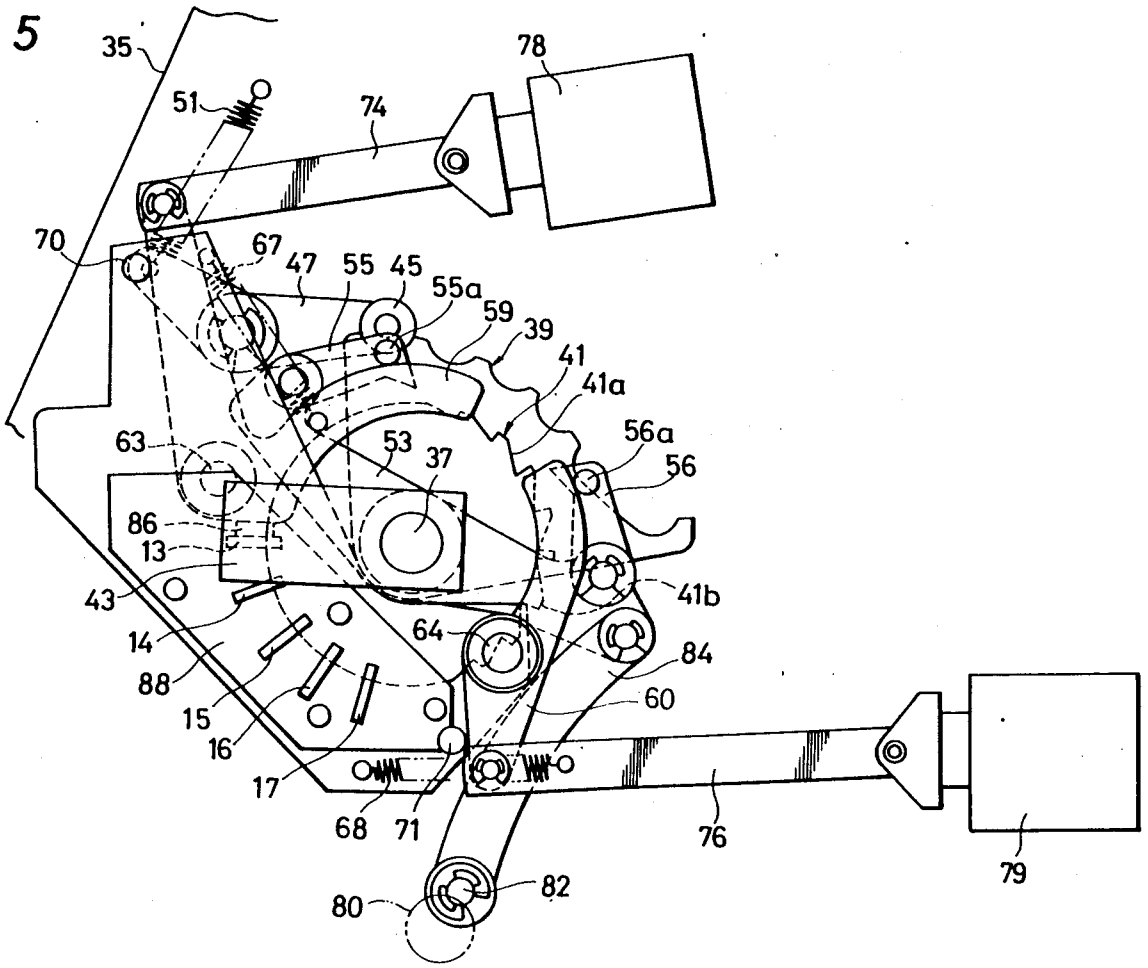
FIGS. 5 and 6 are front views respectively showing operation lever driving systems of the first and second units in the above embodiment.
Figure 6:
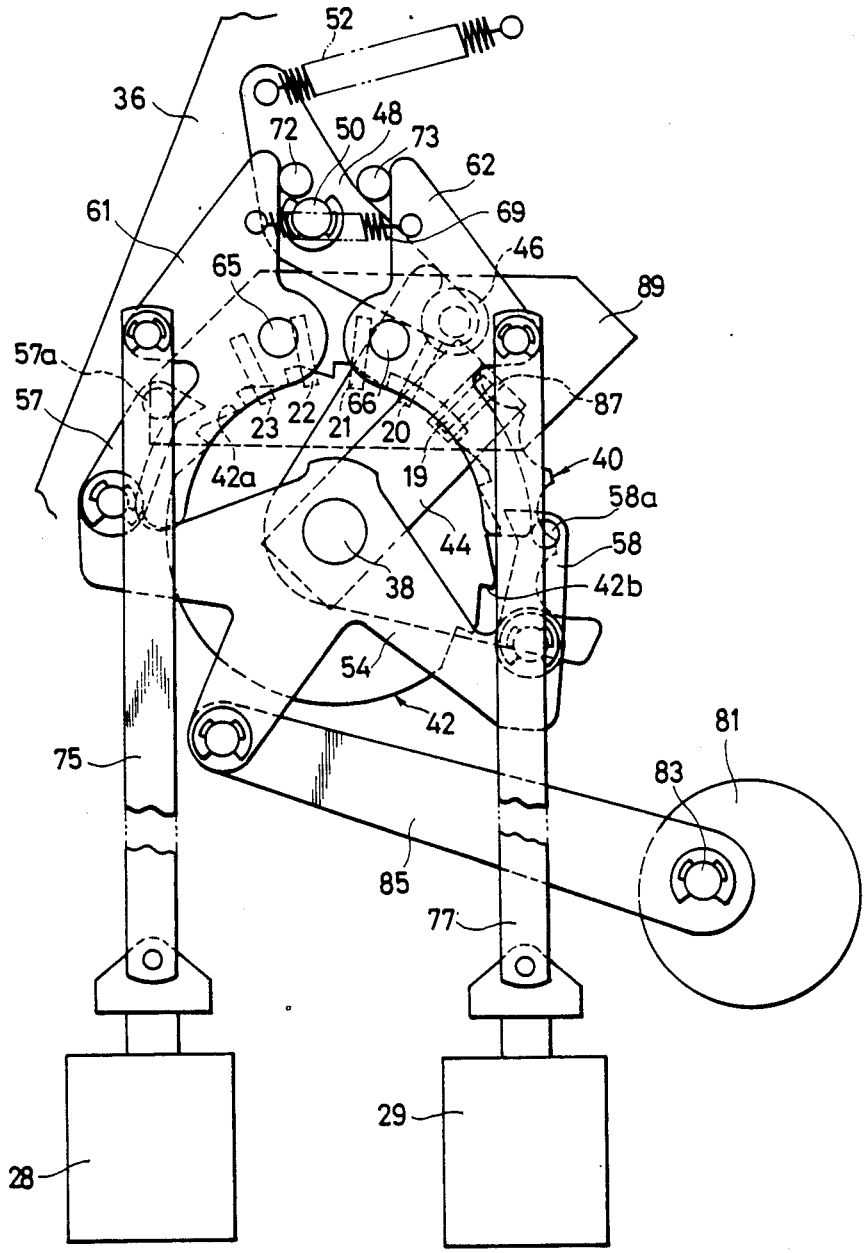
Figure 8:
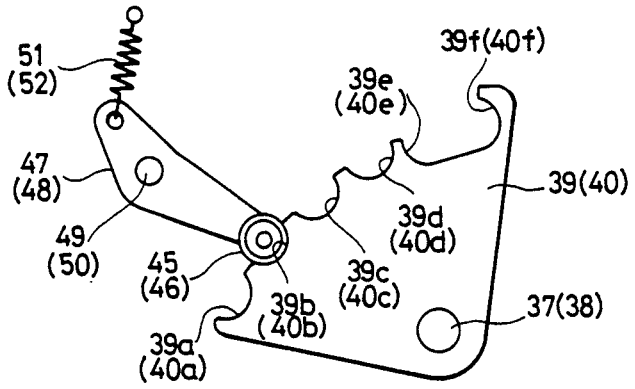
FIG. 8 is a front view of the operation lever changeover mechanism in the above embodiment.

FIG. 5 shows an operation lever driving system of the first unit A, FIG. 6 shows an operation lever driving system of the second unit B, FIG. 7 shows the various possible positions of the operation lever of each of the first and second units A and B, and FIG. 8 shows a mechanism for setting the position of the operation levers operation levers of the first and second units A and B.

In FIGS. 5 and 6, the respective operation lever driving systems of the first and second units are arranged as follows:

In FIGS. 5 and 6, the operation levers 11 and 12 are respectively fixed to the operator's side of drive shafts 37 and 38 rotatably supported between left and right frames 35 and 36, respectively, and set cams 39 and 40, ratchet wheels 41 and 42, and arms 43 and 44, are fixed to the same drive shaft 37 and 38, respectively.

As seen in FIG. 8, the set cams 39 and 40 are substantially fan-shaped and provided with five engaging notch portions 39*a*, 39*b*, 39*c*, 39*d* and 39*e* and five engaging notch portions 40*a*, 40*b*, 40*c*, 40*d*, and 40*e*, respectively, formed on the circumference and centered about the drive shafts 37 and 38 and circumferentially separated at predetermined intervals. Further, there are provided cam portions 39*f* and 40*f* formed as continuations of the engaging notch portions 39*e* and 40*e*, respectively.

Arms 47 and 48, pivotally provided at their respective one ends with engaging rollers 45 and 46, are rotatably supported by shafts 49 and 50 on the frames 35 and 36, respectively. The engaging rollers 45 and 46 are elastically urged in the direction to engage with a selected one of the engaging notch portions 39*a* through 39*e* and the cam portion 39*f*, and in the direction to engage with a selected one of the engaging notch portions 40*a* through 40*e* and the cam portion 40*f*, respectively, by springs 51 and 52 stretched between the respective other ends of the arms and the frames 35 and 36, respectively. Thus, when the set cam 39 or 40 is rotated together with the drive shaft 37 or 38 by the operation lever 11 or 12, the engaging notch portions 39*a* through 39*e* and the cam portion 39*f* or the engaging notch portions 40*a* through 40*e* and the cam portion 40*f* are alternatively selectively engaged by the engaging roller 45 or 46 against the spring force so as to make it possible to change over the position of the operation lever 11 or 12 to a correspondingly selected one of the positions I, II, III, IV and V shown in FIG. 7.

That is, the engaging portions 39*a* through 39*e* and the cam portion 39*f* or the engaging portions 40*a* through 40*e* and the cam portion 40*f* are successively engaged by the engaging roller 45 or 46 so that the position of the operation lever 11 or 12 is selectively changed over from the position I to the positions II, III, IV and V successively and kept at the selected position. After the cam portion 39*f* or 40*f* is engaged by the engaging roller 45 to 46, the set cam 39 or 40 is returned to its initial state so that the engaging notch portion 39*e* or 40*e* is engaged by the engaging roller 45 or 46, respectively, and the operation lever 11 or 12 is caused to come back to the position V from the position VI and then kept at the position V.

In FIGS. 5 and 6, respectively, intermediate portions of the respective arms 53 and 54 are rotatably loosely fitted on the drive shafts 37 and 38, respectively, and a pair of feed pallets 55 and 56 and another pair of pallets 57 and 58 are pivoted on the opposite end portions of the arms 53 and 54, respectively, so as to be disengageably engaged with the ratchet wheels 41 and 42, respectively. A pair of pins 55*a* and 56*a* and another pair of pins 57*a* and 58*a* are fixed in the vicinity of the respective end portions of the pair of feed pallets 55 and 56 and the pair of feed pallets 57 and 58, respectively.

The frames 35 and 36 have a pair of levers 59 and 60 and another pair of levers 61 and 62 swingably supported by a pair of shafts 63 and 64 and another pair of shafts 65 and 66, respectively, such that the respective one end portions of the one and the other pairs of levers 61, 62 and 63, 64 are engaged by the one and the other pairs of pins 55*a*, 56*a* and 57*a*, 58*a*, respectively, so that the one and the other pairs of feed pallets 55, 56 and 57, 58 are made to disengageably engage with the ratchet wheels 41 and 42, respectively, owing to the swinging movement of the one and the other pairs of levers 59, 60 and 61, 62, respectively.

The one and the other pairs of levers 59, 60 and 61, 62 have springs 67 and 68 and a spring 69 stretched therefrom, so that the levers 59 and 62 are urged counterclockwise by the springs 67 and 69, respectively, while the levers 60 and 61 are urged clockwise by the springs 68 and 69, respectively. Thus, the one and the other pairs of levers 59, 60 and 61, 62, respectively, abut on one and another pairs of stoppers 70, 71 and 72, 73, respectively, provided on the frames 35 and 36, so that the all the levers are held at respective predetermined positions against the respective spring force to thereby keep the one and the other pairs of feed pallets 55, 56 and 57, 58 at respective positions apart from the ratchet wheels 41 and 42, respectively.

The respective other end portions of the levers 59 and 61 are connected to the backward-drive solenoids 78 and 28, respectively, through links 74 and 75, and the other end portions of the levers 60 and 62 are connected to the forward-drive solenoids 79 and 29, respectively, through links 76 and 77.

The ratchet wheels 41 and 42 have one and another pair of teeth 41*a*, 41*b* and 42*a*, 42*b*, respectively, directed in different directions so as to be rotated in the forward and reverse directions by the one and the other pairs of feed pallets 55, 56 and 57, 58.

As seen in FIGS. 5 and 6, respectively, there are provided pallet-drive shafts 82 and 83 which perform crank movements in response to shafts 80 and 81, respectively, which rotate in response to the rotation of the printing apparatus. The pallet-drive shafts 82 and 83 are pivotally connected with respective one end portions of the arms 53 and 54 through links 84 and 85 so that the respective arms 53 and 54 are swung by the crank movement of the pallet-drive shafts 82 and 83, respectively. In the case where the feed pallet 55 or 57 is kept in a state of engagement with the respective ratchet wheel 41 or 42, the ratchet wheel 41 or 42 is rotated clockwise in the drawing by the reciprocating movement of the feed pallet 55 or 57, respectively, while, in the case where the feed pallet 56 or 58 is kept in the state of engagement with the ratchet wheel 41 or 42, the ratchet wheel 41 or 42 is rotated counterclockwise in the drawing.

The forward-drive solenoids 79 and 29 are set to be turned on when the operation levers 11 and 12 are at the positions III. Upon the turning-on of solenoids 79 and 29, the levers 60 and 62 are rotated counterclockwise and clockwise, respectively, so that the feed pallets 56 and 58 are released from their restriction and caused to engage with the respective teeth 41*b* and 42*b* of the ratchet wheels 41 and 42 to rotate the ratchet wheels 41 and 42 counterclockwise by the crank movement of the pallet-drive shafts 82 and 83, respectively, so as to rotate the operation levers 11 and 12 from the positions III to the positions IV. As described above, it is possible to cause the operation levers 11 and 12 to advance to the position IV from the position V by controlling the solenoids 79 and 29, respectively.

If the operation levers 11 and 12 are caused to advance and the solenoids 79 and 29 are turned off when the levers 11 and 12 are in their positions VI, the feed pallets 56 and 58 will disengage from the ratchet wheels 41 and 42, respectively. Then, if the backward-drive solenoids 78 and 28 are turned on, the levers 59 and 61 rotate clockwise and counterclockwise, respectively. Then if the backward-drive solenoids 78 and 28 are turned on, the levers 59 and 61 rotate clockwise and counterclockwise, respectively, so that the feed pallets 55 and 57 engage with the ratchet wheels 41 and 42, respectively, and the ratchet wheels 41 and 42 are rotated clockwise in the drawing by the crank movement of the pallet-drive shafts 82 and 83, respectively. Accordingly, the operation levers 11 and 12 are rotated back to their positions V from the positions VI, and successively back to positions IV and III from positions V.

Magnets 86 and 87 are fixed to the arms 43 and 44, respectively, which are fixed to the drive shafts 37 and 38, respectively. On respective rotational loci of the magnets 86 and 87 and on respective mounting plates 88 and 89 fixed to the frames 35 and 36, the one set of five operation lever position detection switches 13–17 and the other set of five operation lever position detection switches 19–23 are radially disposed at suitable intervals at positions corresponding to the positions I, II, III and IV of the operation levers 11 and 12, respectively. The drive shafts 37 and 38 are rotated by the ratchet wheels 41 and 42, respectively, as described above so that when the arms 43 and 44 are rotated together with the magnets 86 and 87, respectively, the magnets 86 and 87 come close to the respective sets of switches 13–17 and 19–23 in succession so that the respective sets of switches 13–17 and 19–23 are successively turned on when the respective operation levers 11 and 12 arrive at their corresponding positions.

Next, referring to FIG. 4, the relation between the position of each of the operation levers 11 and 12 and the operation of the respective devices will be described.

When the operation levers 11 and 12 are at their positions I indicated in FIG. 7, all mechanical operations are stopped. If the respective positions of the operations levers 11 and 12 are changed over to their positions II from the positions I, a drive motor (not shown) is started to turn on water ductor rollers of moisture supply devices of the units A and B, respectively. At this time ink ductor rollers of inking devices are stopped because of the stopped state of paper supply.

If the respective positions of the operation levers 11 and 12 are changed over to their positions II, form rollers touch the plate cylinders 1 and 4, respectively, and then printing plate supply devices are actuated to perform plate supply, and a pump motor is caused to start to prepare for the supply of paper.

Next, when the respective positions of the operation levers 11 and 12 are changed over to their positions IV, the plate cylinders 1 and 4 touch the blanket cylinders 2 and 5, respectively, so that the respective inking devices of the units A and B operate to thereby transfer ink onto the surfaces of the printing plates from the respective form rollers.

Further, when the respective positions of the operation levers 11 and 12 are changed via their positions V to their positions VI, the paper supply devices operate to perform paper supply. Immediately thereafter, the operation levers 11 and 12 turn back to their positions V so as to perform printing.

The changeover of the respective positions of the operation levers 11 and 12 to their positions VI via the positions III, IV and V are automatically performed by controlling the solenoids 79 and 29 to thereby cause the drive shafts 37 and 38 to rotate, as described above.

Upon completion of one cycle of printing at the respective positions V of the operation levers 11 and 12, the solenoids 78 and 28 are turned on so that the operation levers 11 and 12 are automatically turned back successively from their respective positions V to the positions III, the plates are dismounted, and the blankets are cleaned. If the printing plates are next mounted, the operation levers 11 and 12 are automatically advanced from their respective positions III to the positions VI successively and turned back to the positions V to perform the next printing operation.

As described above, the mechanical operations of the first and second units A and B are controlled by the respective operation levers 11 and 12 in the same manner.

Figure 9:
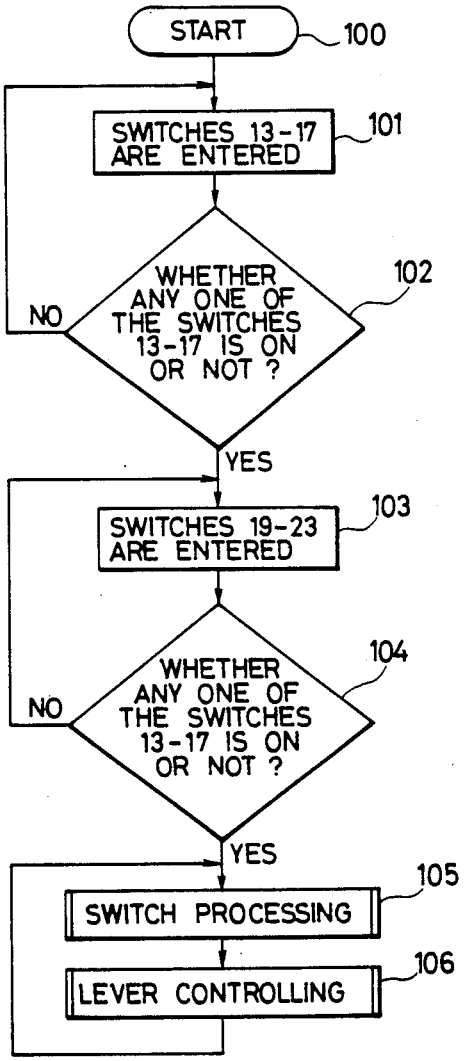
FIGS. 9, 10 and 11 are diagrams for explaining operations in the above embodiment.
Figure 10:
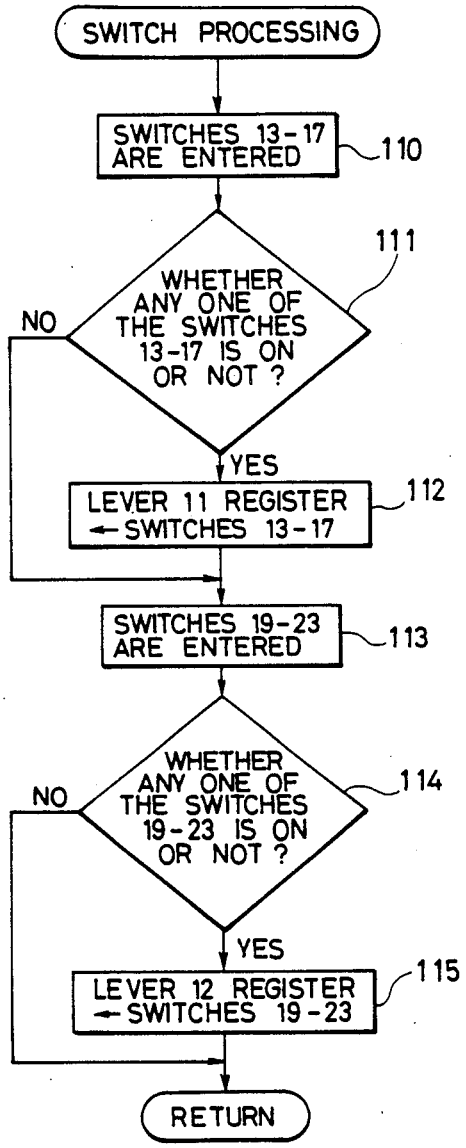
Figure 11:
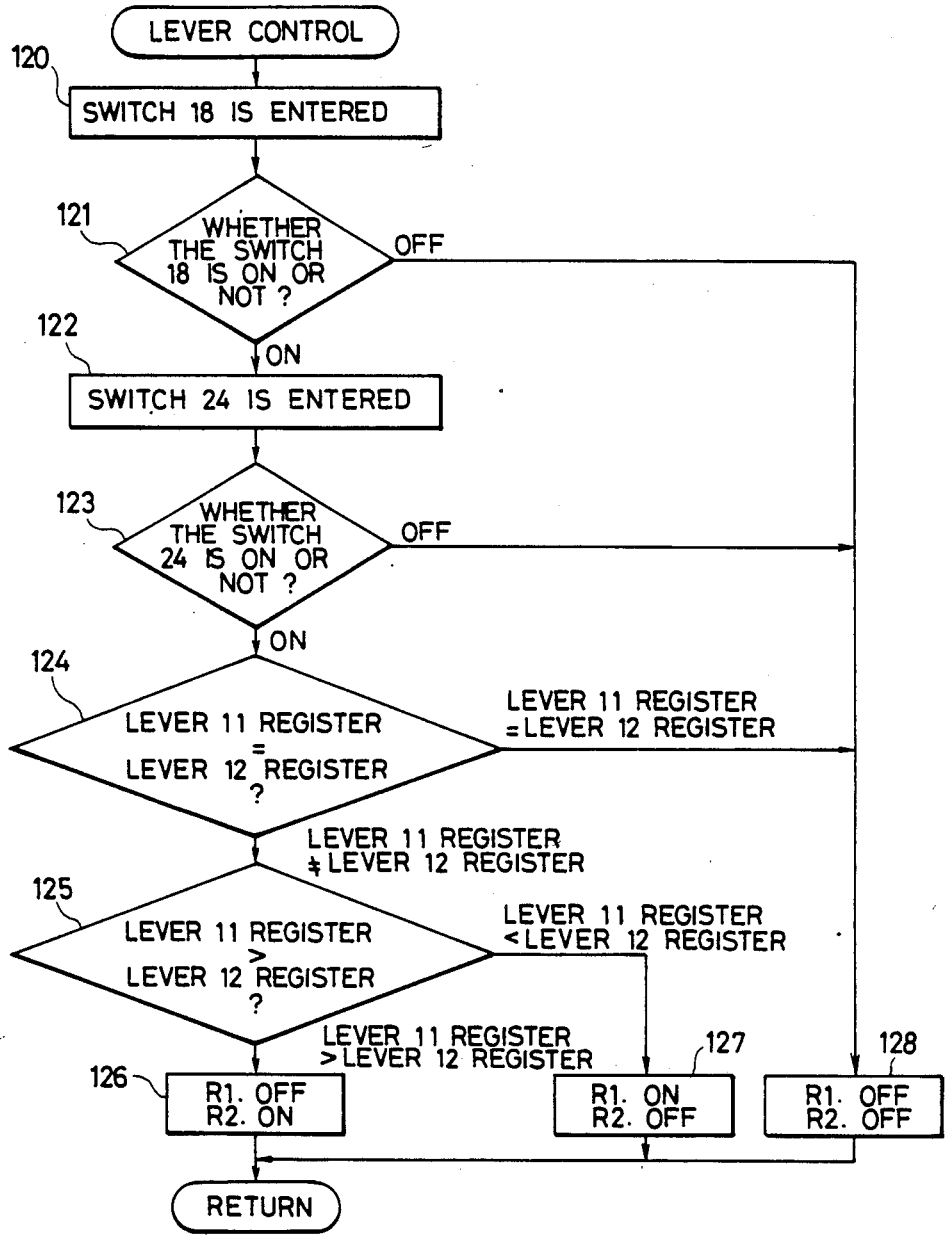

Next, referring to the flowcharts of FIGS. 9 through 11, the operations of the apparatus the present invention will be further described.

In FIG. 9:

Step 100:

Power supply is turned on.

Steps 101–102:

The respective outputs of the position detecting switches 13–17 for the operation lever 11 of the first unit A are entered to check whether any one of the switches is on or not. If none of the switches 13–17 is turned on, waiting is continued until any one of the switches 13–17 turned on.

Steps 103–104:

The respective outputs of the position detecting switches 19–23 for the operation lever 12 of the second unit B are entered to check whether any one of the switches is on or not. If none of the switches 19–23 is turned on, waiting is continued until any one of the switches 13–17 is turned on.

Step 105:

A sub-routine is executed for processing the position detecting switches 13–17 for the operation lever 11 of the first unit A and the position detecting switches 19–23 for the operation lever 12 of the second unit B.

Step 106:

A sub-routine is executed for controlling the operation lever 12 of the second unit B.

In FIG. 10:

Steps 110–112:

The respective outputs of the position detecting switches 13–17 for the operation lever 11 of the first unit A are entered, and when any one of the switches is on, the lever position is stored in a register for the lever 11. During the movement of the lever, if all the switches 13–17 are off, the contents of the register for the lever 11 are not updated.

Step 113–115:

The respective outputs of the position detecting switches 19–23 for the operation lever 12 of the second unit B are entered, and when any one of the switches is on, the lever position is stored in a register for the lever 12. During the movement of the lever, if all the switches 19–23 are off, the contents of the register for the lever 12 are not updated.

In FIG. 11:

Steps 120–123 and 128:

The respective outputs of the changeover switches 18 and 24 are entered, and if either one of the outputs is off, that is, when monochromatic printing is selected, or if both the outputs are off, that is, when non-printing is selected, the relays 26 and 27 for controlling the position of the operation lever 12 of the second unit B are turned off.

Steps 124 and 128:

The respective positions of the operation levers 11 and 12 of the first and second units A and B are compared with each other by means of the respective registers for the operation levers 11 and 12, and if the levers 11 and 12 are in the same position, the relays 26 and 27 for controlling the position of the operation lever 12 of the second unit B are turned off.

Steps 125–127:

The respective positions of the operation levers 11 and 12 of the first and second units A and B are compared with each other by means of the respective registers for the operation levers 11 and 12, and if the operation lever 12 of the second unit B is behind the operation lever 11, the relay 27 for advancing the operation lever 12 is turned on. On the contrary, if the operation lever 12 of the second unit B is ahead of the operation lever 11, the relay 26 for retarding the operation lever 12 is turned on.

In the operation lever controller for a two-color printing apparatus according to the present invention arranged as described above, both the first and second units A and B can be controlled by the operation lever 11 of the first unit A in the case of performing two-color printing, while in the case where monochromatic printing is performed by means of the unit A or B only as selected by the change-over switches 18 and 24, it is possible to control the selected unit A or B by the operation lever thereof, separately from the unused unit. Hence, the present invention provides a two-color printing apparatus having first and second units A and B which is improved in operativity as well as workability.

We claim:

1. An operation lever controller for a two-color printing apparatus which is provided with a first unit A and a second unit B adapted to perform printing independently of each other and which are arranged such that all steps of respective printing operations are performed by rotating respective operation levers in multiple stages, comprising: first and second operation levers, first and second ratchet wheels, first and second set cams for positioning said first and second operation levers, respectively, in multiple stages, first and second arms provided with respective first and second magnets and fixed on respective first and second drive shafts of said first and second units, respectively; first and second pairs of feed pallets provided on respective first and second unit frames and linked with respective first and second forward-drive solenoids, first and second backward-drive solenoids, and first and second pallet-drive shafts arranged such that said first and second pairs of feed pallets, respectively, are disengageably engaged with said ratchet wheels by operation of said first and second forward-drive solenoids, respectively, and said first and second backward-drive solenoids, respectively, to perform feed operations by means of said pallet-drive shafts; first and second sets of operation lever position detection switches arranged to be turned on by said magnets at respective positions of said first second operation levers, respectively; first and second changeover switches for switching the operation mode of said first and second units between in-use and out-of-use modes, said first and second changeover switches being provided on said first and second unit frames, respective; and a microcomputer; whereby, selectively, said first and second units are controlled by said first and second operation levers, respectively, independently of each other, or both said first and second units are controlled by said operation lever of said first unit.

2. The operation lever controller of claim 1, wherein each of said set cams is substantially fan-shaped and have a plurality of engaging notch portions formed on the circumference thereof and centered on a respective one of said drive shafts, and a cam portion continued to an end one of said engaging notch portions.

3. The operation lever controller of claim 2, further comprising, for each of said set cams, an arm pivotally provided at one end with a roller engaging a respective one of said set cams so as to engage a selected one of said engaging notch portions or said cam portion, and spring means for urging said roller into engagement with said set cam.

4. The operation lever controller of claim 1, further comprising, for each of said feed pallets, an arm pivotally coupled to the feed pallet with which said feed pallet is disengageably engaged with a respective one of said ratchet wheels.

5. The operation lever controller of claim 4, further comprising: a pair of shafts rotated when said printing apparatus is performing a printing operation; and a pair of pallet-drive shafts which perform crank movements in response to rotation of respective ones of said shafts, said pallet-drive shafts being pivotally connected with respective end portions of said arms pivotally coupled to said feed pallets so that said arms are swung by crank movement of said pallet-drive shafts.

6. The operation lever controller of claim 1, further comprising, for each of said pairs of feed pallets, a pair of swingably mounted levers, spring means for biasing said levers, and a link for coupling said levers to respective ones of said backward-drive solenoids.

* * * * *